US007308995B2

(12) United States Patent
Uchiyama et al.

(10) Patent No.: US 7,308,995 B2
(45) Date of Patent: Dec. 18, 2007

(54) NAILING MACHINE

(75) Inventors: Toru Uchiyama, Tokyo (JP); Mitsugu Takezaki, Tokyo (JP); Satoshi Osuga, Tokyo (JP)

(73) Assignee: Max Co., Ltd., Tokyo (JP)

( * ) Notice: Subject to any disclaimer, the term of this patent is extended or adjusted under 35 U.S.C. 154(b) by 177 days.

(21) Appl. No.: 10/567,863

(22) PCT Filed: Aug. 26, 2004

(86) PCT No.: PCT/JP2004/012691

§ 371 (c)(1),
(2), (4) Date: Feb. 10, 2006

(87) PCT Pub. No.: WO2005/025808

PCT Pub. Date: Mar. 24, 2005

(65) Prior Publication Data

US 2006/0261121 A1 Nov. 23, 2006

(30) Foreign Application Priority Data

Sep. 10, 2003 (JP) ..... 2003-318154

(51) Int. Cl.
*B25C 1/04* (2006.01)

(52) U.S. Cl. ..... 227/8; 227/130; 227/142

(58) Field of Classification Search ..... 227/8, 227/120, 130, 142, 129; 123/46 SC
See application file for complete search history.

(56) References Cited

U.S. PATENT DOCUMENTS 4,629,106 A * 12/1986 Howard et al. ..... 227/8
5,551,621 A * 9/1996 Vallee ..... 227/8
5,669,541 A * 9/1997 Ronconi ..... 227/8
5,791,545 A * 8/1998 Lin ..... 227/8
6,116,488 A * 9/2000 Lee ..... 227/8
6,419,140 B1 * 7/2002 Chen ..... 227/8
6,581,814 B1 * 6/2003 Hsu ..... 227/8
6,662,989 B1 * 12/2003 Chang et al. ..... 227/8
6,675,999 B2 * 1/2004 Mukoyama et al. ..... 227/8
6,857,547 B1 * 2/2005 Lee ..... 227/8
6,886,729 B1 * 5/2005 Lee ..... 227/8
6,974,062 B2 * 12/2005 Akiba ..... 227/8

FOREIGN PATENT DOCUMENTS

JP A-9-109058 4/1997
JP A-9-225855 9/1997
JP B2-2727960 12/1997

* cited by examiner

*Primary Examiner*—Scott A. Smith
(74) *Attorney, Agent, or Firm*—Morgan, Lewis & Bockius LLP

(57) ABSTRACT

A nailing machine includes a switch operating member 40 for setting to switch respective modes of single striking and continuous striking, and pivot restricting mechanism for restricting a contact lever 34 for operating a valve stem 19 of a start valve 15 from being pivoted in cooperation with the switch operating member 40 set to switch to the single striking mode. By the pivot restricting mechanism, an amount of pivoting the contact lever 34 at a position of operating to draw a middle of a trigger lever 31 in the single striking mode is restricted, and a valve stem 19 is maintained to maintain a state of operating to make the start valve 15 ON.

Therefore, a reaction of the nailing machine in the continuous striking is reduced, further, dribble in the single striking mode is prevented from being brought about. In addition thereto, an erroneous operation in connecting an air chuck is prevented.

6 Claims, 14 Drawing Sheets

NAILING MACHINE

TECHNICAL FIELD

The present invention relates to a nailing machine for striking a nail supplied to the nose portion to a work, when a start valve is operated ON by operating both of a trigger lever operated by the finger of the hand grasping the nailing machine and a contact arm operated by pressing a nose portion forming an injection port of striking out a nail to the work.

BACKGROUND ART

There is known a nailing machine for continuously striking nails supplied to an inside of an injection port by a driver when the driver coupled to a piston is slidingly driven by impulsively driving the piston at an inside of a cylinder by compressed air as a power source. According to the nailing machine, the nailing machine is started by two operations of an operation of drawing a trigger lever formed at a base portion of a grip portion of grasping the nailing machine and an operation of pressing a contact arm arranged to be projected at a front end of the nose portion to a work. A nail is struck by the driver connected to the piston by driving the piston by compressed air introduced into the cylinder.

As types of striking a nail by such a nailing machine, there are a continuous striking mode for starting the nailing machine by pressing the contact arm to the work after operating to draw the trigger lever first and a single striking mode for starting the nailing machine by operating to draw the trigger lever after positioning the nose portion of the nailing machine at a struck portion of the work and operating the contact arm. In the continuous striking mode, the nailing machine is continuously started at each time of pressing the nose of the nailing machine to the work while operating to draw the trigger lever, as a result, nails are struck continuously. In the single striking mode, a nail is struck firmly to a determined position of striking. In addition thereto, in the single striking mode, twice striking or the like (dribble striking phenomenon), in which the nailing machine jumps up by a reaction and the nose portion is pressed again to the work to operate the contact arm, is not occurred.

There is an apparatus of starting a nailing machine of a background art in which the continuous striking mode and the single striking mode are automatically switched in the same nailing machine and a nailing operations are made to be able to be carried out in the respective modes. According to the nailing machine of the background art, a switch operating member is provided to move up and down integrally with the contact arm, in the single striking mode for operating the trigger lever after operating the contact arm, the switch operating member and the contact arm are maintained at upper positions by the trigger lever, by engaging the switch operating member or the contact arm maintained on an upper side and the contact lever, a valve stem of a start valve is maintained in an ON operating state, further, the valve stem of the start valve is made to be able to be operated up to an OFF position by resolving the switch operating member from being maintained by the operation of releasing the trigger lever.

In the single striking mode of driving the nailing machine by operating the trigger lever after operating the contact arm by pressing the nose portion of the nailing machine to a surface of the work, in order to prevent the dribble striking phenomenon in which when the nailing machine is started by operating the start valve ON by operating the valve stem by operating to draw the trigger lever, the contact arm is returned by moving upward the nailing machine by the reaction to separate the nose portion from the surface of the work and thereafter, when the nailing machine is moved down to operate the contact arm again, the nail is struck again, a position of making the start valve ON by operating the trigger stem of the start valve upward and a position of making the start valve OFF by moving the trigger stem of the start valve in the ON state in the lower direction are set to be shifted from each other such that the start valve is operated to be ON at an upper position of an operating stroke of the valve stem and such that the start valve is operated to be OFF at a lower position of the operating stroke of the valve stem. Further, according to the nailing machine having the switch operating member of the background art, a lower position of the valve stem of the start valve is restricted such that the valve stem maintains the ON state by the switch operating member, so far as the trigger lever is operated to draw, regardless of operating the contact arm upward and downward, the start valve is not made to be OFF and even when the contact arm is operated again, the nailing machine is prevented from being restarted. (JP-B2-2727960)

Meanwhile, when nails are struck continuously by the continuous striking mode, the contact arm is operated by an operation of pressing the nose portion to a face of the work by swinging down the nailing machine to the work in a state of operating to draw the trigger lever and a nail is struck by starting the nailing machine by making the start valve ON in the midst of swinging down. The continuous nail striking operation is made to be easy to carry out by absorbing the reaction produced when the nailing machine is driven by driving the nailing machine in this way while swinging down the nailing machine. When the start valve is set to be made ON at a portion of the operating stroke of the valve stem proximate to un upper dead center, the start valve is made ON at a final side of the operating stroke of the contact arm, and there is a case in which the nailing machine is driven after grounding the nose portion of the nailing machine which is swung down and the reaction cannot be absorbed, the large reaction is produced at the nailing machine and the nailing machine is considerably separated from the face of the work to deteriorate operability.

In order to reduce the reaction of the nailing machine in the continuous striking mode, it is necessary to operate the start valve ON at an early timing of the stroke of the contact arm, however, in order to make the start valve operated to be ON at an early timing, it is necessary to set the position for making the valve stem ON in the lower direction of the stroke. However, when the position of making the valve stem ON is set to be proximate to a side of a lower dead center, the amount of shifting the ON position and the OFF position of the valve stem is reduced. Therefore, there is brought about the dribble in which the contact arm is returned when the nailing machine is moved upward by the reaction in the single striking mode as described above, at that occasion, the start valve is brought into the ON state by moving down the valve stem to the OFF position and the nailing machine is driven again by operating the contact arm again. Or there is a case in which after operating the contact arm in a state in which air is not supplied to the nailing machine, in a state of maintaining the single striking mode by operating to draw the trigger lever, the valve stem of the start valve is arranged upward from the ON position by the switch operating member and therefore, when an air chuck is connected under the state, the start valve is operated to be ON to erroneous operate the nailing machine.

DISCLOSURE OF THE INVENTION

It is a problem of the invention to provide a starting apparatus of a nailing machine resolving the problem of the background art and capable of automatically setting to switch respective modes of continuous striking and single striking by an order of operating two members of a trigger lever and a contact arm. Further, it is a problem thereof to provide a nailing machine reducing a reaction of the nailing machine in continuous nailing in the continuous striking mode, further, preventing dribble in the single striking mode from being brought about and an erroneous operation when the nailing machine is connected with an air chuck in a state of maintaining the single striking mode.

In order to resolve the above described problem, according to a nailing machine of the invention, in a nailing machine constituted by a striking mechanism constituted by a piston integrally coupled with a driver for striking a nail and a cylinder slidably accommodated with the piston, a housing accommodating the striking mechanism and attached with a nose portion for slidably guiding the driver at a front end thereof, a start valve for driving the striking mechanism by supplying compressed air into the cylinder and operating the striking mechanism to return to an initial position by exhausting the compressed air from inside of the cylinder, and a contact lever one end side of which is axially supported pivotably by a trigger lever operated by the finger and an operating end of other end thereof is arranged to be opposed to an upper end of a contact arm operated by bringing a nose portion into contact with a work, and driving the striking mechanism by operating a valve stem of the start valve by the contact lever operated to pivot by operating the trigger lever and the contact arm, a front end portion of the contact arm is provided with a switch operating member for setting to switch a single striking mode and a continuous striking mode, pivot restricting means for restricting the contact lever for operating the valve stem of the start valve from being pivoted when the switch operating member is set to be switched to the single striking mode is provided, an amount of pivoting the contact lever at a position of operating to draw a middle of the trigger lever in the single striking mode is restricted by the pivot restricting means, thereby, the valve stem of the start valve is maintained to maintain a state of operating to make the start valve ON.

Further, the pivot restricting means is constituted by an operating lever supported so as to be pivoted by the switch operating member operated to the single striking mode, the operating lever is arranged to be opposed to the contact lever for operating the valve stem of the start valve, when the switch operating member is set to the single striking mode, the operating lever is engaged with the middle portion of the contact lever to restrict the amount of pivoting the contact lever, thereby, the start valve is maintained to maintain an ON operating state at a position of operating to draw a middle of the trigger lever.

Further, the pivot restricting means is constituted by an operating piece integrally formed with the switch operating member to direct upward on a rear side of the switch operating member, the operating piece is arranged to be opposed to the middle portion of the contact lever, when the switch operating member is set to the single striking mode, the operating piece is engaged with the middle portion of the contact lever to restrict an amount of pivoting the contact lever, thereby, the valve stem of the start valve is maintained to maintain the state of operating to make the start valve ON at a position of operating to draw the middle of the trigger lever.

A starting apparatus of the nailing machine of the invention is provided with the switch operating member for setting to switch the single striking mode and the continuous striking mode at the front end portion of the contact arm, and provided with the pivot restricting means for restricting the contact lever for operating the valve stem of the start valve from being pivoted when the switch operating member is set to switch to the single striking mode, the amount of pivoting the contact lever at the position of operating to draw the middle of the trigger lever in the single striking mode is restricted by the pivot restricting means, thereby, the valve stem of the start valve is maintained to maintain the ON operating state of the start valve and therefore, while setting to start the nailing machine at a fast timing of an operating stroke of the contact lever in the continuous striking mode, a difference between positions of operating the valve stem of the start valve when the trigger lever is operated to draw to a position of operating to make the start valve ON and a single striking maintaining state in which the trigger lever is maximally operated to draw is reduced, the erroneous operation when the nailing machine is connected with the air chuck in the single striking maintaining state of maximally operating to draw the trigger lever can be prevented and dribble in single striking can be prevented from being brought about.

Further, the pivot restricting means is constituted by the operating lever supported so as to be pivoted by the switch operating member operated in the single striking mode, the operating lever is arranged to be opposed to the contact lever for operating the valve stem of the start valve, when the switch operating member is set to the single striking mode, the operating lever is engaged with the middle portion of the contact lever to restrict the amount of pivoting the contact lever, thereby, the start valve is maintained to maintain the ON operating state at the position of operating to draw the middle of the trigger lever and therefore, the erroneous operation when the nailing machine is connected with the air chuck in the single striking maintaining state of maximally operating to draw the trigger lever can be prevented and dribble in single striking can be prevented.

Further, the pivot restricting means is constituted by the operating piece integrally formed with the switch operating member to direct upward on the rear side of the switch operating member, the operating piece is arranged to be opposed to the middle portion of the contact lever, when the switch operating member is set to the single striking mode, the amount of pivoting the contact lever is restricted by engaging the operating piece with the middle portion of the contact lever, thereby, the valve stem of the start valve is maintained such that the start valve maintains the ON operating state at the position of operating to draw the middle of the trigger and therefore, the erroneous operation when the nailing machine is connected with the air chuck in the single striking maintaining state of maximally operating to draw the trigger lever is prevented and dribble in single striking can be prevented from being brought about.

BRIEF DESCRIPTION OF THE DRAWINGS

FIG. 3A shows a state before operating the start valve in which a valve stem is arranged at a position of a lower dead center, FIG. 3B shows a state of operating the start valve to be ON by operating the valve stem from the lower dead center to an upper dead center, FIG. 3C shows a state in which the valve stem is operated to be OFF by operating the valve stem from the upper dead center to the lower dead center.

BEST MODE FOR CARRYING OUT THE INVENTION

First Embodiment

Figure 1:
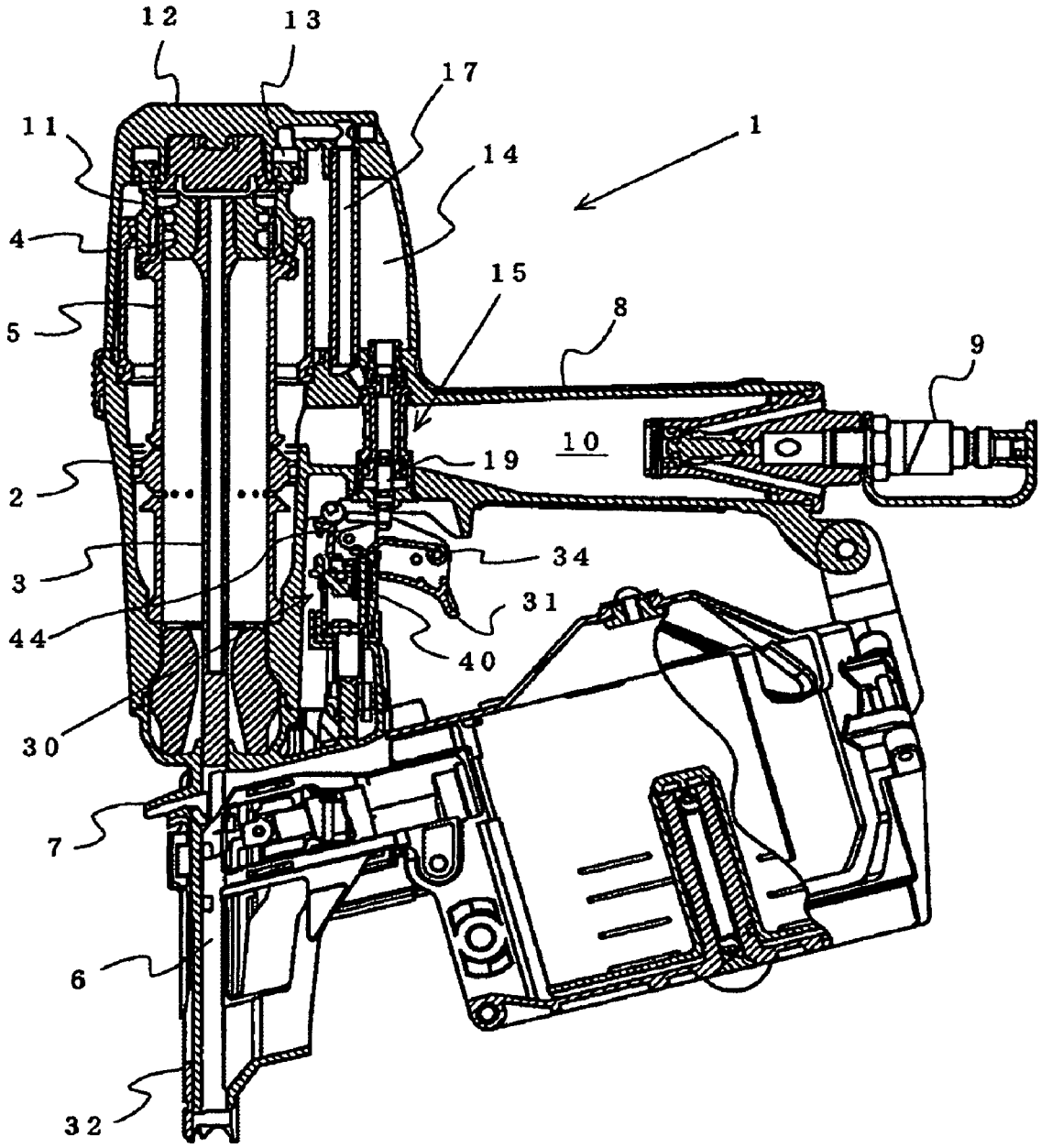
FIG. 1 is a vertical sectional side view showing a nailing machine according to a first embodiment of the invention.

An explanation will be given of a starting apparatus of a nailing machine according to a first embodiment of the invention in reference to FIG. 1 through FIG. 11. As shown by FIG. 1, a nailing machine 1 is provided with a housing 2 integrally formed with a grip portion 8 to direct in a rear direction. The housing 2 is accommodated with a striking mechanism. The striking mechanism is constituted by a piston 4 and a cylinder 5. A lower face of the piston 4 is coupled with a driver 3 for striking a nail. Further, the piston 4 is slidably accommodated in the cylinder 5. A front end portion of the housing 2 is attached with a nose portion 7. The nose portion 7 is formed with an injection port 6 for slidingly guide the driver 3 coupled to the piston 4. Inside of the grip portion 8 formed at the housing 2 is provided with an air chamber 10 for storing compressed air supplied from a compressed air source by way of an air plug 9 attached to a rear end of the grip 8. By supplying compressed air in the air chamber 10 into the cylinder 5, the piston 4 is impulsively driven and a nail supplied into the injection port 6 is struck out in a direction of the front end of the nose portion 7 by the driver 3.

A main valve 11 formed in a ring-like shape is provided on an upper side of the cylinder 5 in the housing 2. The main valve 11 drives the piston 4 by supplying compressed air in the air chamber 10 into the cylinder and operates the piston to return by exhausting compressed air after driving the piston 4 from inside of the cylinder 5 to the atmosphere. An upper end portion of the main valve 11 is accommodated in a ring-like chamber 13 formed at an upper housing 12 arranged at an upper portion of the housing 2. By supplying compressed air into the ring-like chamber 13, the main valve 11 is operated to shut off inside of the cylinder 5 from the air chamber 10 and connect the cylinder 5 to the atmosphere. Further, by exhausting compressed air at inside of the ring-like chamber 13 to the atmosphere, by operation of compressed air at inside of the air chamber 10 operated to a lower end portion of the main valve 11, the main valve 11 is operated to shut off inside of the cylinder 5 from the atmosphere and connect inside of the cylinder 5 to the air chamber 10.

Figure 2:
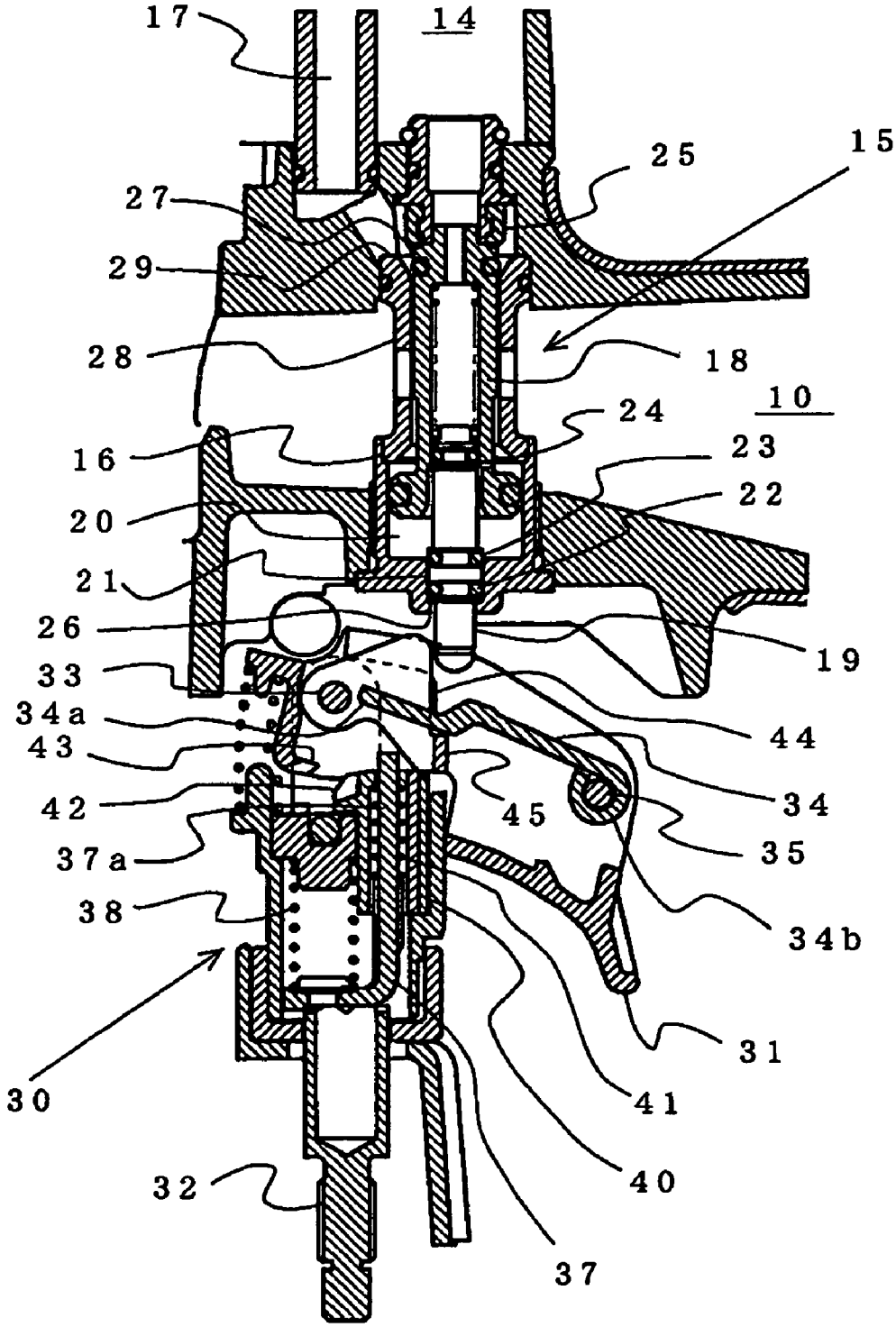
FIG. 2 is a vertical sectional side view enlarging an essential portion of the nailing machine of FIG. 1.

Further, a start valve 15 is provided at a base portion of the grip portion 8. The start valve 15 starts the nailing machine 1 by operating the main valve 11 by controlling compressed air at inside of the ring-like chamber 13 accommodated with the main valve 11. As shown by FIG. 2, the start valve 15 is constituted by a pilot valve 18 in a hollow shape and a valve stem 19. The pilot valve 18 is slidably accommodated in a valve housing 16 by forming a piston portion at a lower end thereof in a cylindrical shape. An upper end portion of the valve stem 19 is accommodated at inside of the hollow portion of the pilot valve 18 and a lower end thereof is arranged to be projected from the valve housing 16. An upper portion of the pilot valve 18 is integrally formed with a valve member. The valve member is operated to selectively connect an air path 17 communicated with the ring-like chamber 13 to between the air chamber 10 and an exhaust chamber 14. Further, the valve stem 19 is operated to bring inside of a valve chamber 20 formed on a lower side of a piston portion of the pilot valve 18 at inside of the valve housing 16 into a shut off or communicating state with or from the atmosphere. Further, the valve stem 19 is operated to control compressed air to flow into or shut off from the valve chamber 20 in cooperation with the pilot valve 18.

Figure 3A:
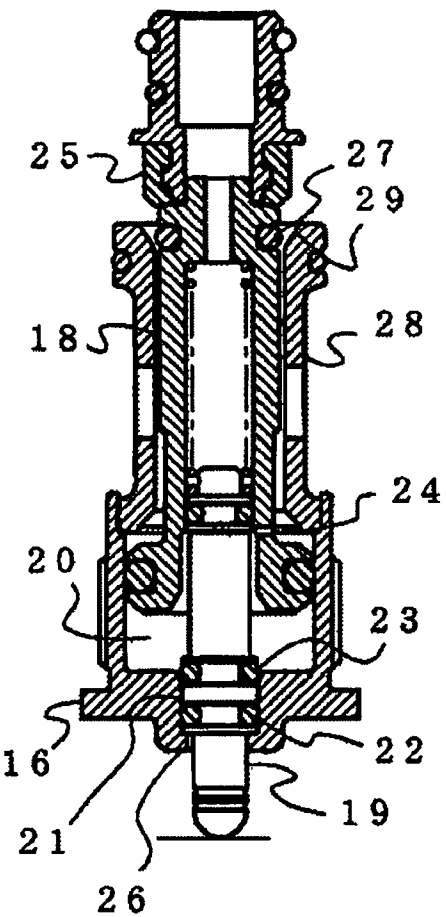
FIG. 3A, FIG. 3B and FIG. 3C are sectional views showing a state of operating a start valve of the nailing machine of FIG. 1.

The valve stem 19 is provided with a first O ring 22 fitted to inside of a cylindrical portion 21 formed at inside of the valve housing 16 and a second O ring 23 fitted to inside of the hollow portion of the pilot valve 18. As shown by FIG. 3A, before being operated at which the valve stem 19 is arranged at a lower dead center, the first O ring 22 is fitted to inside of the cylindrical portion 21 of the valve housing 16 to shut off an exhaust port 26 communicating inside of the valve chamber 20 with the atmosphere. Inside of the valve chamber 20 is supplied with compressed air at inside of the air chamber 10 by way of an opening 24 formed at a peripheral wall face of the pilot valve 18. By a pressure of the compressed air, the pilot valve 18 is moved upward, an upper end of the pilot valve 18 is brought into close contact with an exhaust valve seat 25 to shut off the air path 17 from the exhaust chamber 14 and connect the air path 17 to the air chamber 10, compressed air is supplied to the ring-like chamber 3 of the main valve to shut off the cylinder 5 from the air chamber 10.

Figure 3B:
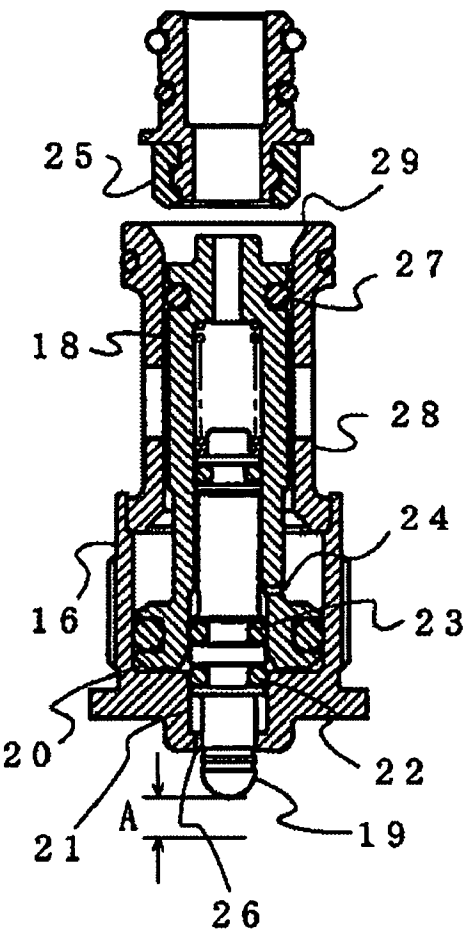

When the valve stem 19 is operated upward from the lower dead center position and the valve stem 19 is operated to an ON potion (first middle position) at dimension A from the lower dead center as shown by FIG. 3B, the first O ring 22 of the valve stem 19 is drawn out from the cylindrical portion 21 of the valve housing 16, compressed air at inside of the valve chamber 20 is exhausted from the exhaust port 26 and pressure at inside of the valve chamber 20 is lowered. Thereby, the pilot valve 18 is operated in a lower direction by compressed air at inside of the air chamber 10, a third O ring 27 arranged at an upper portion of the pilot valve 18 is fitted with an intake valve seat 29 formed at an upper end of a ring-like sleeve 28 to shut off the air path 17 from the air chamber 10. Further, by separating the upper end of the pilot valve 18 from the exhaust valve seat 25, the air path 17 is communicated with the exhaust chamber 14 and compressed air at inside of the ring-like chamber 13 is exhausted to the atmosphere. Thereby, the main valve 11 is operated to the upper side, inside of the cylinder 5 is communicated with the air chamber 10 and compressed air at inside of the air chamber 10 is supplied into cylinder 5.

Figure 3C:
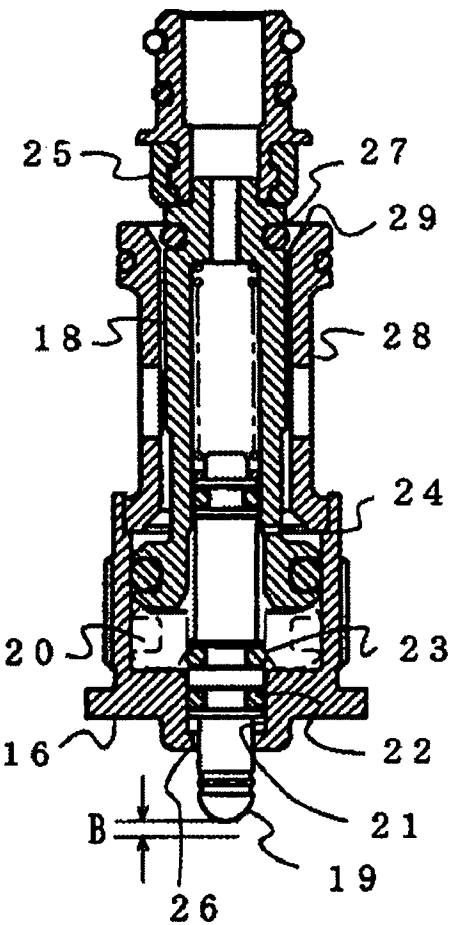

When compressed air at inside of the valve chamber 20 of the start valve 15 is exhausted, the pilot valve 18 is operated to the lower side and the start valve 15 is operated to the ON state, the second O ring 23 of the valve stem 19 is fitted into the hollow portion of the pilot valve 18 to shutoff compressed air supplied into the valve chamber 20 by way of the opening 24. When the valve stem 19 is operated in the lower direction after making the start valve 15 ON, the first O ring 22 of the valve stem 19 is fitted to the cylindrical portion 21 of the valve housing 16 and the valve housing 16 is shut off from the atmosphere. However, at this occasion, as described above, the second O ring 23 is fitted into the hollow portion of the pilot valve 18 to shut off compressed air from flowing into the valve chamber 20 and therefore, the start valve 15 maintains the ON state. As shown by FIG. 3C, when the valve stem 19 is operated to an OFF position (second middle position) at dimension B from the lower dead center, the second O ring 23 of the valve stem 19 is drawn out from the hollow portion of the pilot valve 18 to supply compressed air into the valve chamber 20 by way of the opening 24. By the compressed air, the pilot valve 18 is operated upward and the start valve 15 is operated to the OFF state.

That is, by operating the valve stem 19 from the lower dead center position to the ON position (first middle position) directed upward by an amount of dimension A shown in FIG. 3B, the start valve 15 is operated to the ON state and the striking mechanism is driven. On the other hand, when the valve stem 19 is operated downward from the ON operating state and operated to the OFF position (second middle position) at dimension B from the upper dead center as shown by FIG. 3C, the start valve 15 is operated to the OFF state to return the striking mechanism to an initial state.

In other words, the valve stem 19 is operated among the lower dead center, the upper dead center, the first middle position (FIG. 3B) for operating the start valve in the OFF operating state to be ON when operated from the lower dead center in the direction of the upper dead center, and the second middle position (FIG. 3C) for operating the start valve in the ON operating state to be OFF when operated from the upper dead center in the direction of the lower dead center. Further, the first middle position (FIG. 3B) is disposed on the side of the upper dead center of the second middle position (FIG. 3C).

A starting apparatus 30 for operating the valve stem 19 is formed on the lower side of the valve stem 19 projected downward from the valve housing 16 of the start valve 15. The starting apparatus 30 is constituted by a trigger lever 31 and a contact arm 32. The trigger lever 31 is formed to be pivotably supported by a base portion of the grip portion 8 so as to be able to be operated by the finger of the hand grasping the grip portion 8. The contact arm 32 is arranged by projecting a lower end portion thereof in a direction of a front end of the injection port 6 and is operated by pressing the nose portion 7 formed with the injection port 6 for striking to guide a nail to the work. The trigger lever 31 is formed in a U-like shape in a section thereof and one end side thereof is axially supported pivotably by a pivoting shaft 33. A contact lever 34 for operating the valve stem 19 by being engaged with a lower end of the valve stem 19 of the start valve 15 is arranged between two side walls of the trigger lever 31. One end side of the contact lever 34 is pivotably supported by a rotating shaft 35 between the side walls of the trigger lever 31 to form an axially supporting portion 34*b*. On the other hand, other end side of the contact lever 34 is arranged in a direction of the pivoting shaft 33 of the trigger lever 31 to form an operating end 34*a*.

As shown by FIG. 1, the contact arm 32 is supported by the nose portion 7 to be able to be slid along the injection port 6 formed at the nose portion 7. A lower end portion of the contact arm 32 is arranged to be projected in the direction of the front end of the injection port 6. The contact arm 32 is operated to be slid to the upper side by bringing the injection port 6 of the nose portion 7 into contact with a face of the work when nailing is carried out by the nailing machine 1. Further, as shown by FIG. 2, an upper end portion of the contact arm 32 is fixed with an L-like piece 37. A vertical portion 37*a* directed upward of the L-like piece 37 is arranged to be opposed to the operating end 34*a* of the contact lever 34. Thereby, by operating the contact arm 32 upward, the operating end 34*a* of the contact lever 34 is operated to an upper position. A spring 38 is arranged to be brought into contact with a horizontal portion of the L-like piece 37, thereby, the lower end of the contact arm 32 is urged to be projected in the direction of the front end of the injection port 6 of the nose portion 7.

A switch operating member 40 for setting a continuous striking mode and a single striking mode is slidably carried by the vertical portion 34*a* of the L-like piece 37 attached to the front end of the contact arm 32. The switch operating member 40 is formed in a cylindrical shape to accommodate the vertical portion 34*a* of the L-like piece 37 and is urged to the upper side by the spring 41 arranged between the switch operating member 40 and the contact arm 32. Engaging means comprising an engaging projected portion 42 formed to be projected from the switch operating member 40 and an engaging jaw portion 43 formed to be projected from the trigger lever 31 is formed between the switch operating member 40 and the trigger lever 31. When the trigger lever 31 is operated to pivot, the engaging jaw portion 43 of the trigger lever 31 is engaged with the engaging projected portion 42 of the switch operating member 40 in an up and down direction. The switch operating member 40 hampers the switch operating member 40 and the contact arm 32 from moving in the lower direction by engaging the engaging jaw portion 43 of the trigger lever 31 to the lower side of the switch operating member 40 moved upward integrally with the contact arm 32 by operating the contact arm 32 in setting the single striking mode for operating to draw the trigger lever 31 after operating the contact arm 32. As a result, the operating end 34*a* of the contact lever 34 is engaged with the switch operating member 40 and therefore, an amount of pivoting the contact lever 34 is restricted and the start valve 15 is maintained in the ON state.

Further, the starting apparatus 30 is formed with pivot restricting means (pivot restricting mechanism) for restricting an amount of pivoting the contact lever 34 axially supported by the trigger lever 31. The pivot restricting means is constituted by an operating lever 44. The operating lever 44 is pivotably supported on inner sides of the two side walls of the trigger lever 31 by the pivoting shaft 33 for pivotably supporting the trigger lever 31. The operating lever 44 is pivoted by being engaged with an upper end face of the switch operating member 40 when the switch operating member 40 is operated to an upper side to set to the single striking mode. Further, by engaging an operating piece 45 formed at the operating lever 44 with a middle portion of the contact lever 34 axially supported by the trigger lever 31 by the operating lever 44, an amount of pivoting the contact lever 34 in a state of operating the trigger lever 31 to the middle portion is restricted.

An explanation will be given of respective operation modes of the continuous striking mode and the single striking mode by the starting apparatus 30 of the nailing machine 1 having the above-described constitution.

Figure 4:
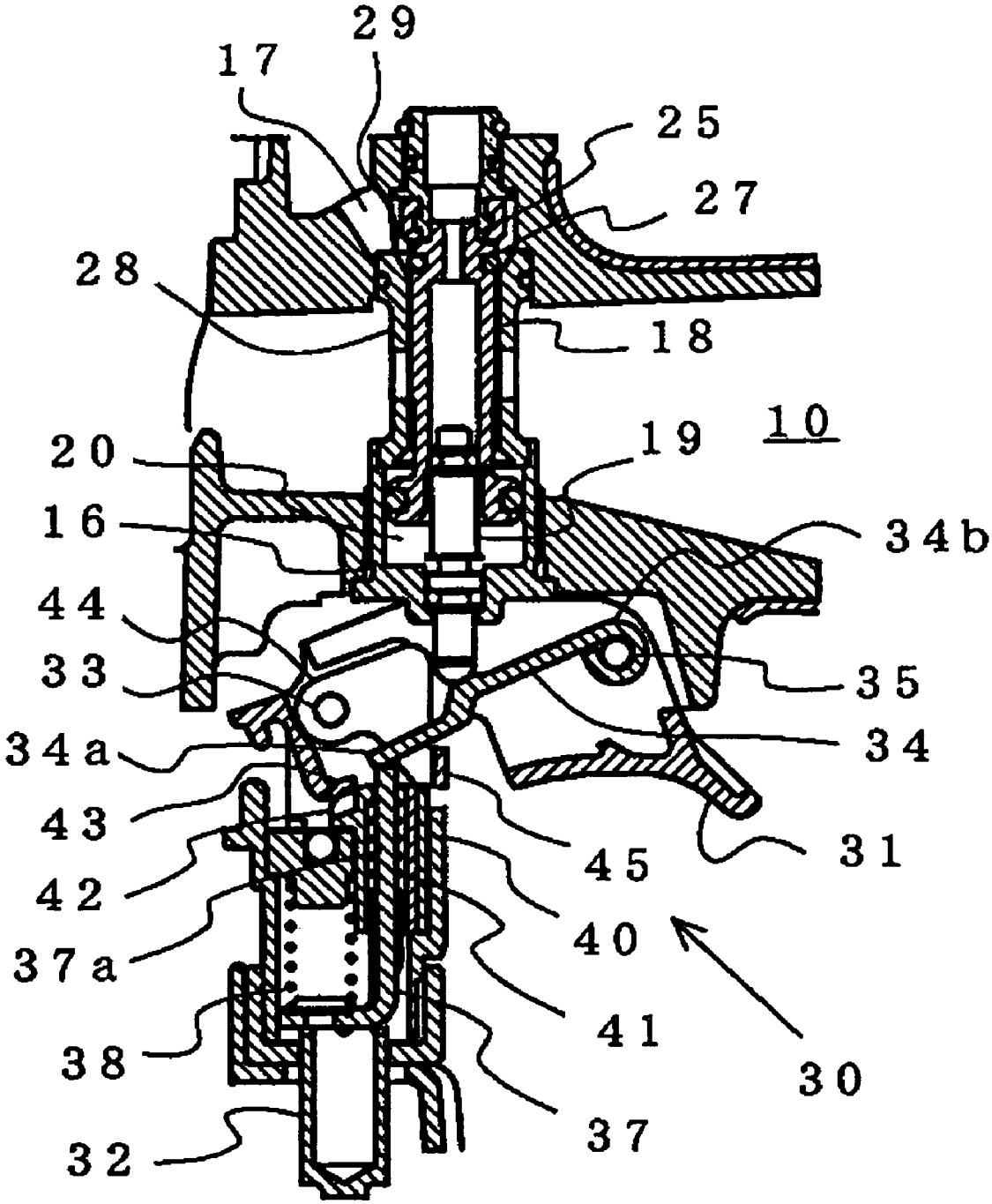
FIG. 4 is a sectional view showing an operating state in which a trigger lever is operated to be drawn in a continuous striking mode of a starting apparatus of FIG. 1.

When the continuous striking mode is selected, as shown by FIG. 4, first, the trigger lever 31 is operated to be drawn by the finger of the hand grasping the grip portion 8 and the trigger lever 31 is pivoted to a maximum drawing position. Under the state, the operating end 34*a* of the contact lever 34 is supported by the upper end face of the switch operating member 40. Therefore, by pivoting the lever 31, the side of the axial supporting portion 34*b* of the contact lever 34 is moved upward and pivoted centering on the side of the operating end 34*a,* however, the valve stem 19 of the start valve 15 is not operated to the ON position and the nailing machine 1 is not started.

Figure 5:
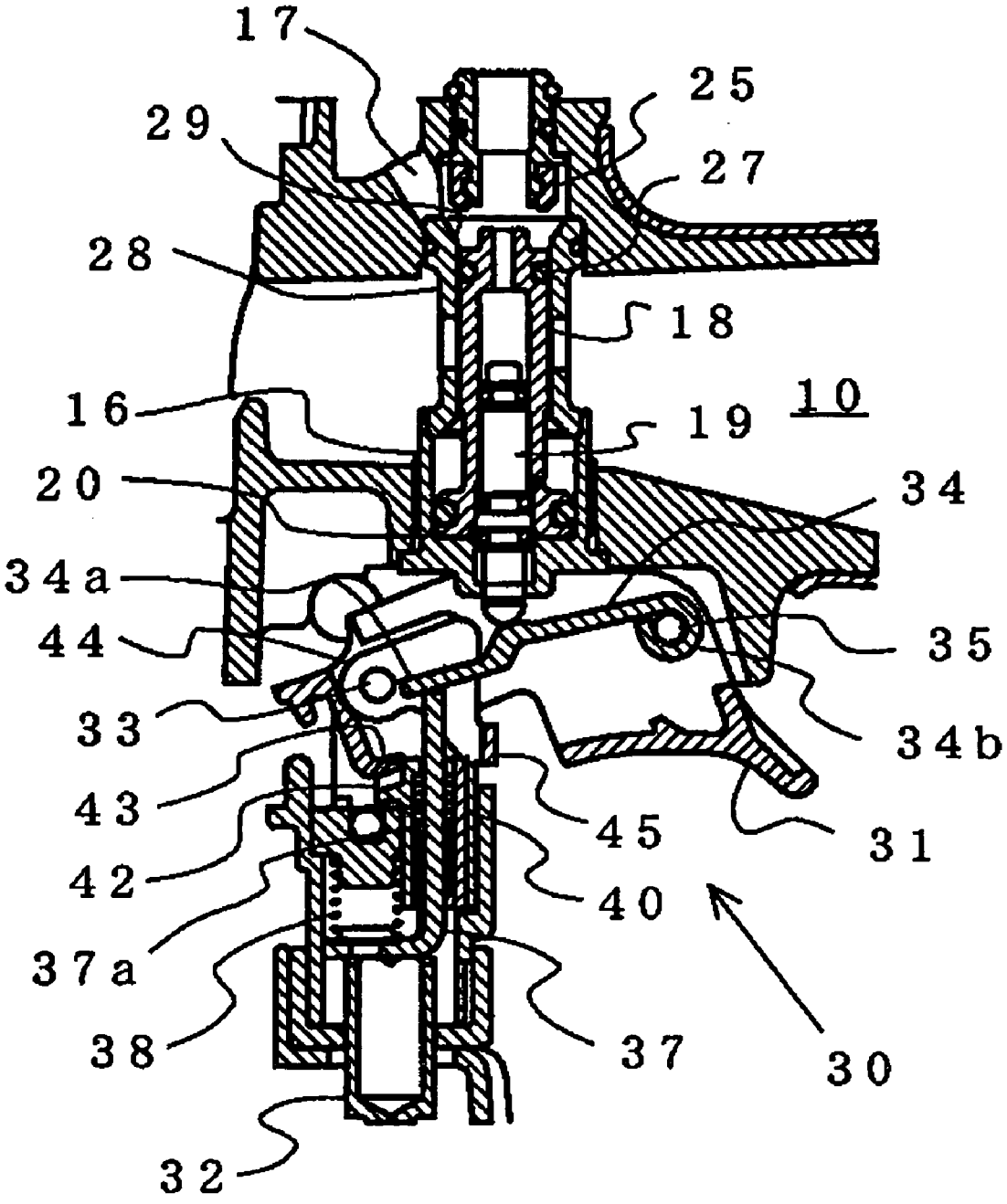
FIG. 5 is a sectional view of the starting apparatus the same as that of FIG. 4 showing an operating state at an instance of making a start valve ON by operating a contact arm.

Next, the contact arm 32 is operated such that the front end of the nose portion 7 is pressed to the surface of the work by swinging down the nailing machine 1 from the upper side to the face of the work. At this occasion, as shown by FIG. 5, the engaging projected portion 42 of the switch operating member 40 is engaged with the lower face of the engaging jaw portion 43 of the trigger lever 31 and cannot be moved upward and therefore, the vertical portion 37*a* of the L-like piece 37 fixed to the upper end of the contact arm 32 is moved upward, the operating end 34*a* of the contact lever 34 is pressed up and the contact lever 34 is pivoted centering on the side of the axially supported end 34*b.* As a result, when the valve stem 19 is operated to the ON position (first meddle portion) shown by FIG. 3B, mentioned above, the start valve is operated to be ON, the striking mechanism is operated by way of the main valve 16 and a nail is struck to the work.

Figure 6:
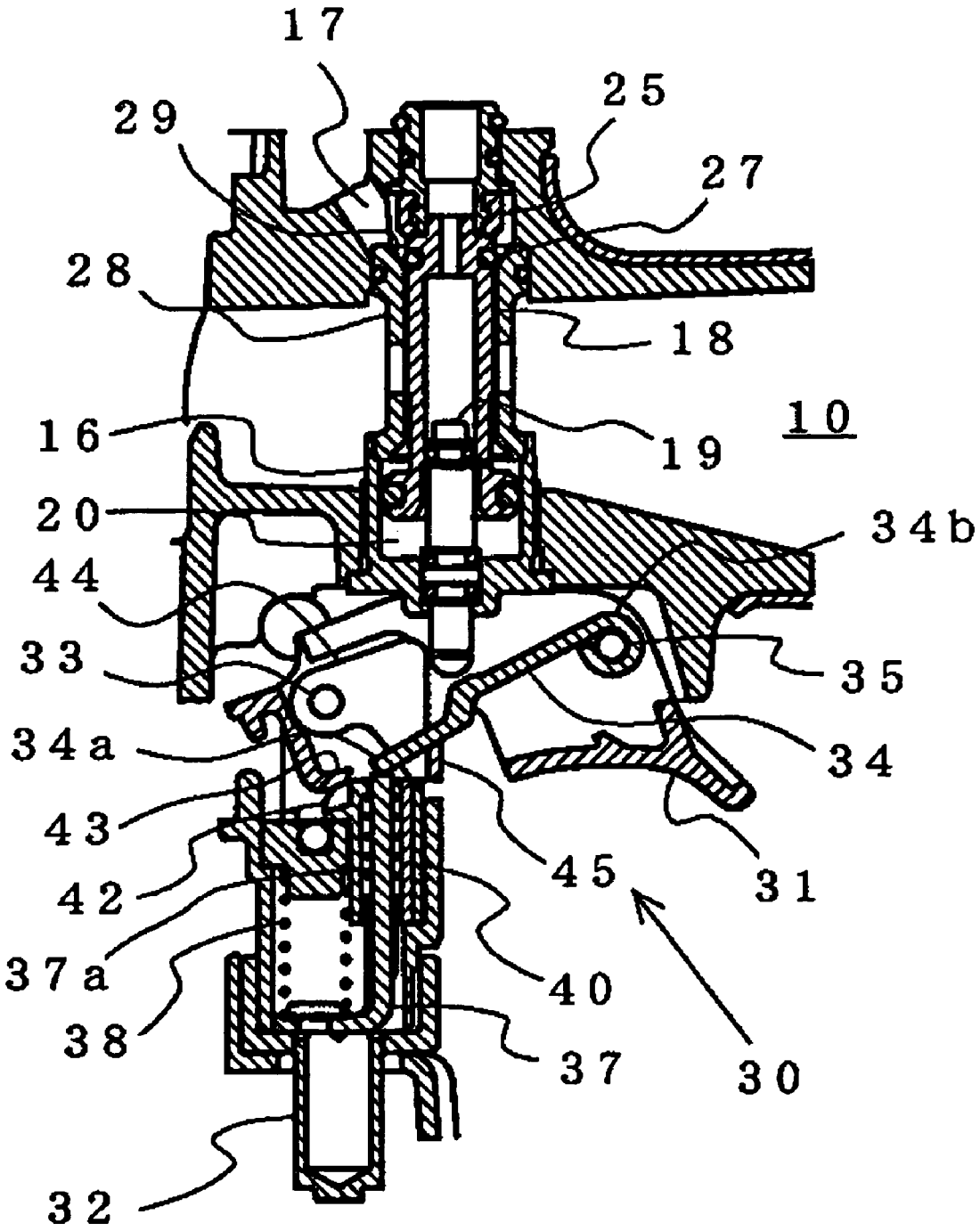
FIG. 6 is a sectional view of the starting apparatus the same as that of FIG. 4 showing a state in which the start valve is operated to be OFF by operating the contact arm to the lower dead center after striking a nail.

After finishing to strike the nail, when the nailing machine 1 is separated from the face of the work while operating to draw the trigger lever 31, the contact arm 32 is returned to move downward by the spring 38, as shown by FIG. 6, in accordance with moving down the contact arm 32, the contact lever 34 is pivoted to the lower dead center centering on the axially supporting portion 34*b.* Therefore, the valve stem 19 which has been at the ON position by the contact lever is operated to the position of the lower dead center and the start valve is made to be OFF. As a result, the start valve 15 is operated to be OFF and the striking mechanism is returned to the initial state. When the contact arm 32 is operated by swinging down the nailing machine 1 again from the state, in accordance with moving the contact arm 32 upward, the contact lever 34 is pivoted to press up the valve stem 19 to the upper dead center and therefore, the start valve 15 is operated to be ON again and the striking mechanism is driven.

In this way, by repeating operation of pressing the nose portion 7 of the nailing machine 1 and separating the nose portion 7 therefrom while operating to draw the trigger lever 31, at each time of operating the contact arm 32, the start valve 15 is operated to be ON and OFF to continuously drive the striking mechanism and therefore, continuous striking can be carried out. Further, after finishing the series of continuous nailing operation, when the trigger lever 31 is operated to release, the valve stem of the start valve 15 is operated to the lower dead center and the start valve is operated to be OFF to return to the initial state. As described above, after releasing the trigger lever 31, even when the contact arm 32 is operated, the valve stem 19 is not operated to a position of making the start valve 15 ON.

Figure 7:
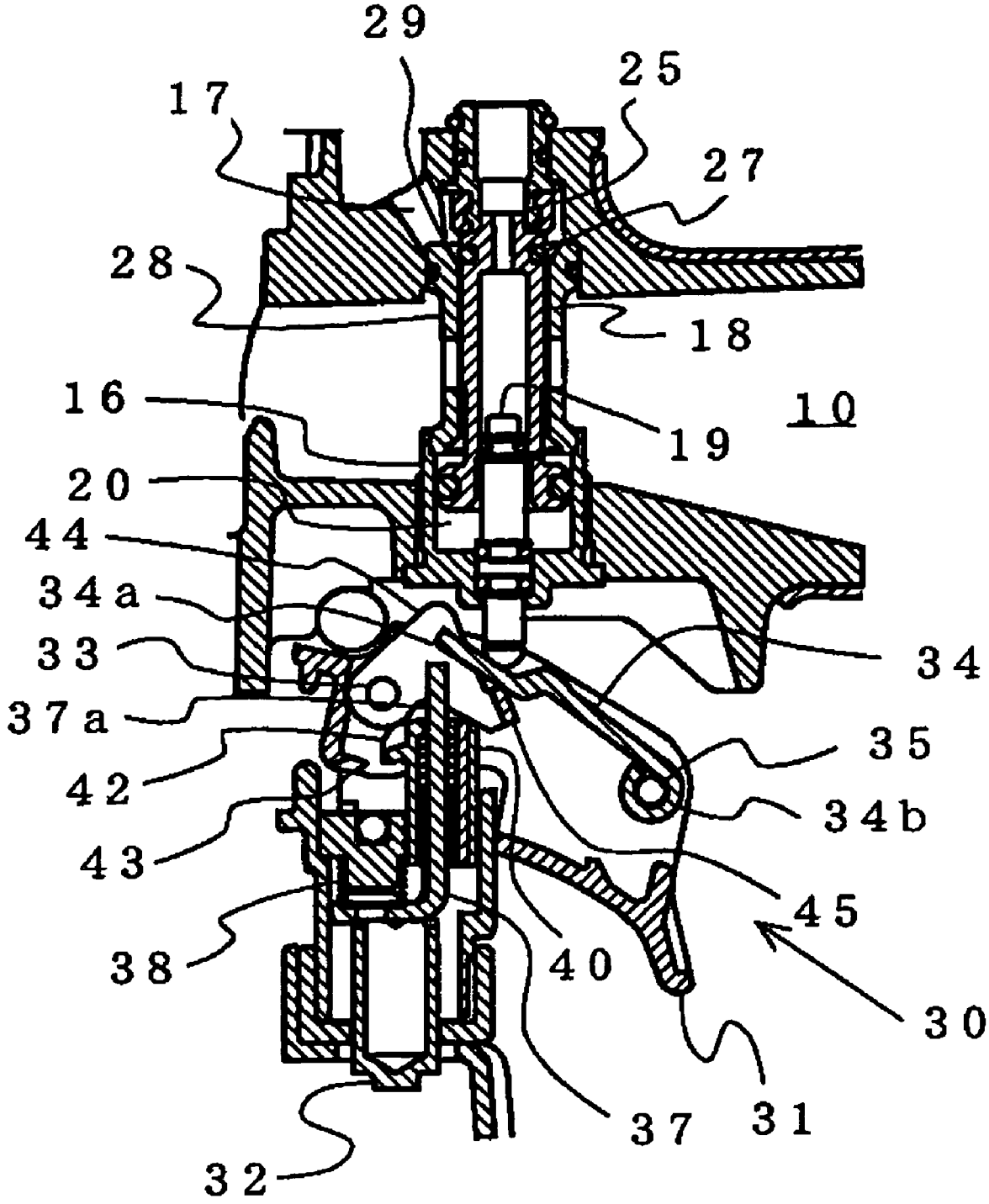
FIG. 7 is a sectional view showing a state of operating the contact arm to the upper dead center for operating the starting apparatus of FIG. 1 in a single striking mode.

Next, when nailing is carried out by the single striking mode, first, as shown by FIG. 7, the nose portion 7 of the nailing machine 1 is pressed to the work and the contact arm 32 is operated upward. Thereby, the front end of the vertical portion 37*a* of the L-like piece 37 fixed to the upper end of the contact arm 32 presses up the side of the operating end 34*a* of the contact lever 34 to pivot. In accordance with moving the L-like piece 37 upward, also the switch operating member 40 is moved upward, thereby, the operating lever 44 is pivoted in the counterclockwise direction of the drawing and the operating piece 45 of the operating lever 44 is engaged with the middle portion of the contact lever 34 to pivot the contact lever 34. The trigger lever 31 is not operated to pivot and therefore, by only pivoting the contact lever 34, the valve stem 19 of the start valve 15 is not operated at all.

Figure 8:
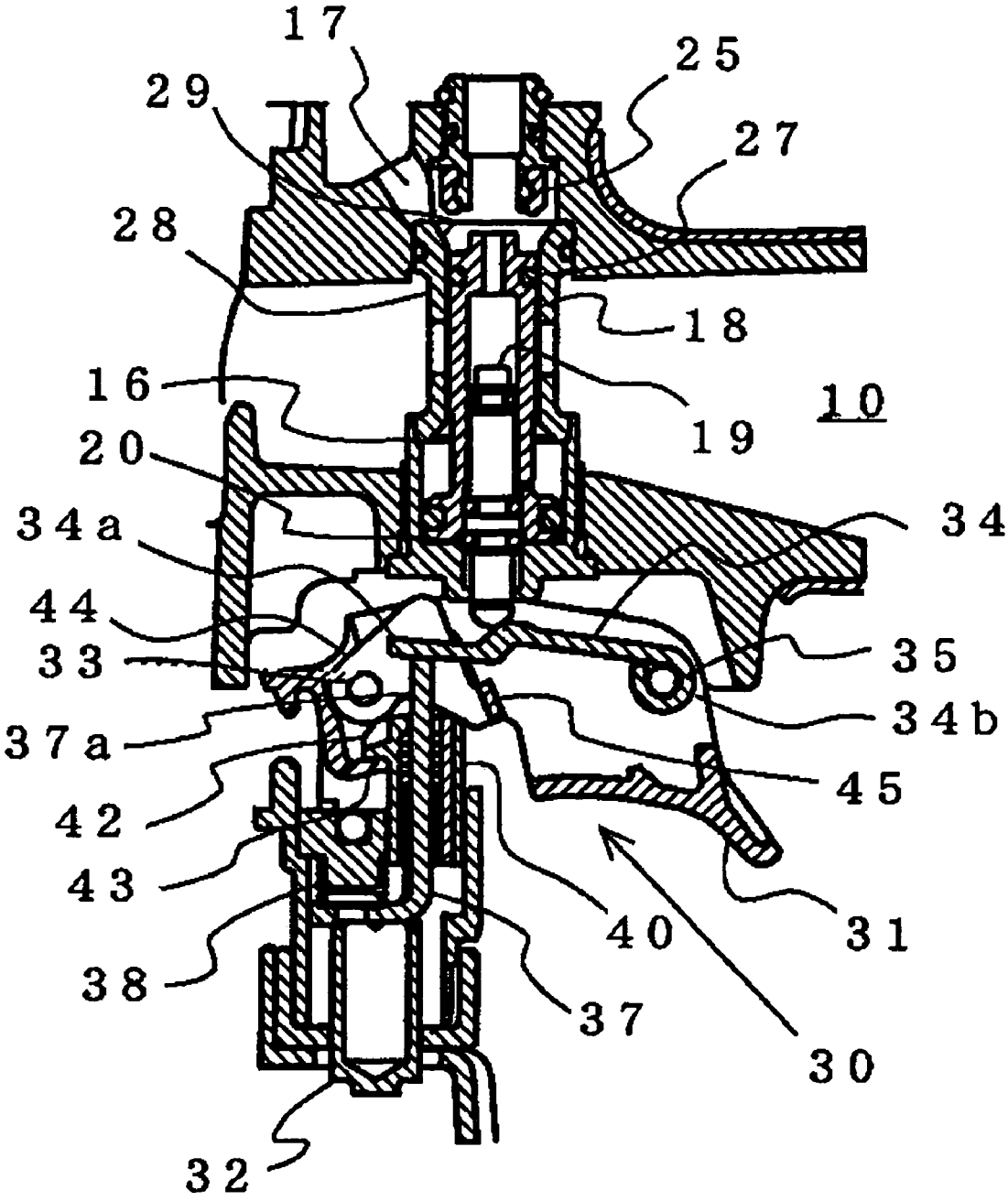
FIG. 8 is a sectional view of the starting apparatus the same as that of FIG. 7 showing an operating state at an instance of making the start valve ON by operating to pivot the trigger lever.

Thereafter, by operating to draw the trigger lever 31, the trigger lever 31 is pivoted and as shown by FIG. 8, the side of the axially supporting end 34*b* of the contact lever 34 is pressed up to pivot the contact lever 34 centering on the side of the operating end 34*a.* When the valve stem 19 is operated to be pressed up to the ON position (first middle position) shown in FIG. 3B, the start valve 15 is made to be ON, the striking mechanism is driven and nailing operation is carried out.

Figure 9:
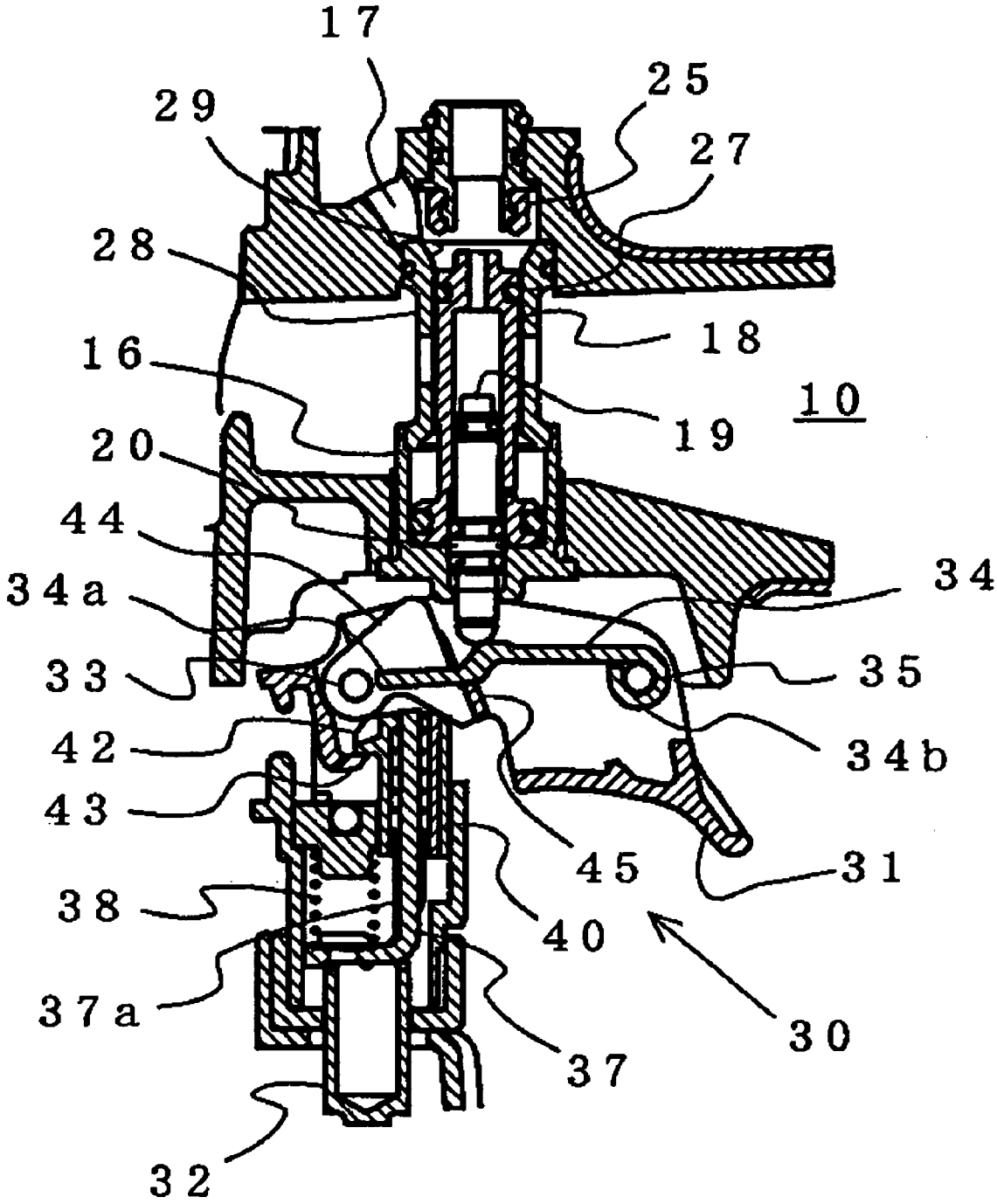
FIG. 9 is a sectional view of the starting apparatus the same as that of FIG. 7 showing a state of operating the contact arm in a direction of the lower dead center by reaction of the nailing machine.

In the single striking mode, there is a case in which when the nailing machine 1 is driven by operating to draw the trigger lever 31, the nailing machine 1 is jumped up to the upper side by the reaction and the contact arm 32 is operated downward. As shown by FIG. 9, even when the contact lever 34 is operated in the lower direction at the position of pivoting the trigger lever 31 by which the start valve 15 is made to be ON, the switch operating member 40 is engaged with the trigger lever 31 to be maintained at the upper position and therefore, the operating lever 44 is arranged at the position of being pivoted by engaging with the switch operating member 40. Therefore, the operating piece 45 formed at the operating lever 44 is operated to restrict an amount of pivoting the contact lever 34 by engaging with the middle portion of the contact lever 34 and therefore, thereby, the valve stem 19 of the start valve 15 is maintained on the upper side of the OFF position (second middle position) shown in FIG. 3C and therefore, there is not brought about dribble striking by grounding the nailing machine 1 moved upward by the reaction again to the work.

Figure 10:
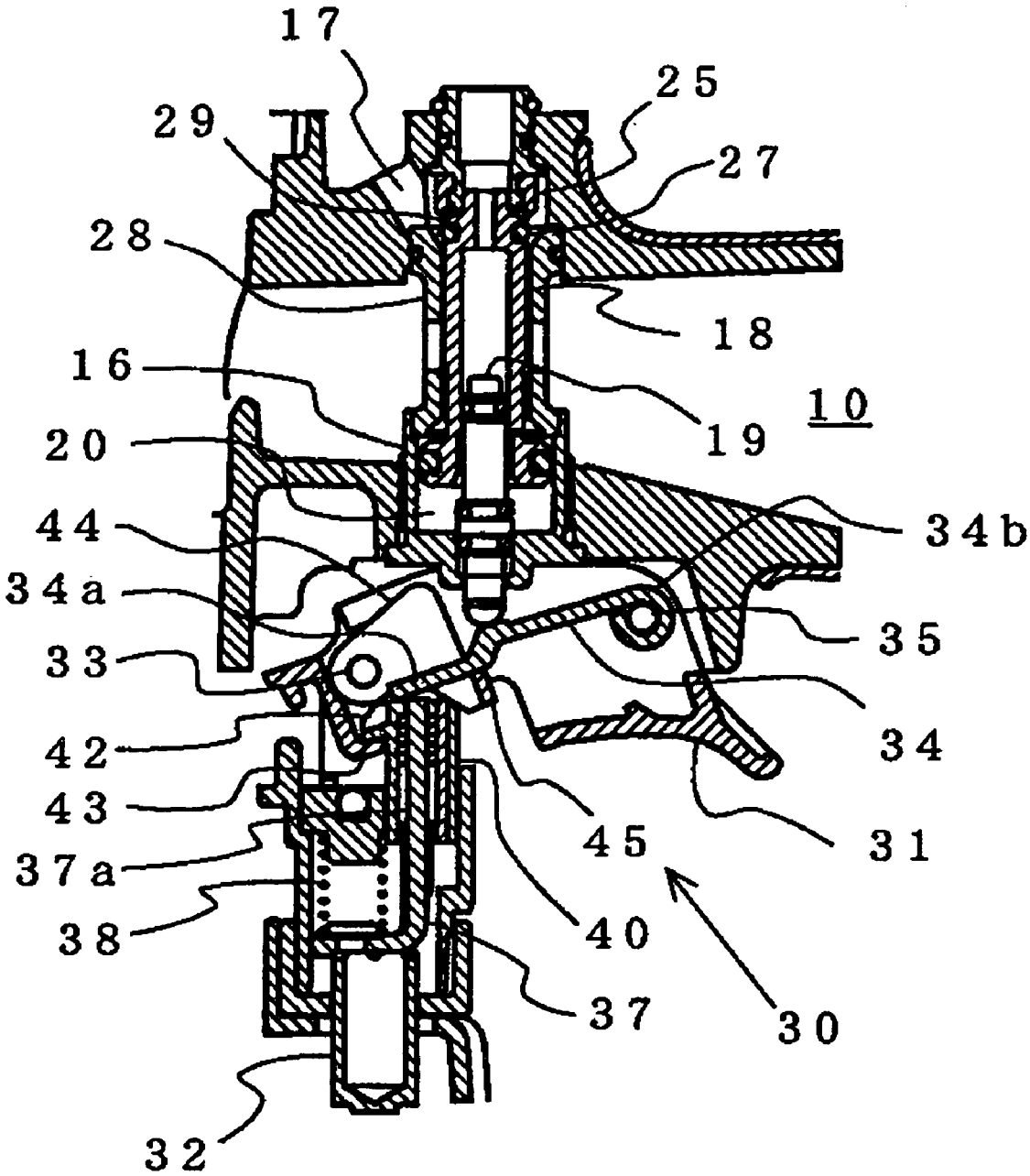
FIG. 10 is a sectional view of the starting apparatus the same as that of FIG. 7 showing a state of maintaining the single striking mode by operating to draw the trigger lever to a maximum drawing position.

After carrying out nailing by driving the nailing machine 1, when the contact arm 32 is going to be released to be moved to return to the lower side by separating the nailing machine 1 from the work while operating to draw the trigger lever 31, as shown by FIG. 10, the engaging projected portion 42 of the switch operating member 40 is engaged with the upper face of the engaging jaw portion 43 to restrict the switch operating member 40 from moving to the lower dead center. The amount of pivoting the contact lever 34 is restricted by being engaged with the upper end face of the switch operating member 40 and therefore, the valve stem 19 is maintained at the position of maintaining the ON state, also the main valve 11 stays to be in the ON state and therefore, the striking mechanism cannot be operated to return to the initial state and therefore, even when the contact arm 32 is operated to be pressed to the work again, the striking mechanism is not driven. That is, the continuous striking cannot be carried out. Therefore, the dribble striking is prevented.

By releasing the trigger lever 31 operated to be drawn from the state shown in FIG. 10, the state of engaging the engaging projected portion 42 of the switch operating member 40 and the engaging jaw portion 43 of the trigger lever 31 is released and therefore, the switch operating member 40 and the contact arm are moved to the position of the lower dead center, also the operating lever 44 pivoted by the switch operating member 40 is pivoted in the clockwise direction, the contact lever 34 is released from being restricted to pivot, in accordance therewith, also the valve stem 19 is operated downward to the position of the lower dead center. Thereby, the start valve 15 is operated to be OFF to return to the initial state of FIG. 2. Therefore, the single striking can be carried out by repeating the same operating procedure.

As described above, according to the embodiment, the pivoting restricting means (pivoting restricting mechanism) for restricting the amount of pivoting the contact lever 34 is constituted by the operating lever 44 pivoted by the switch operating member 40 operated in the single striking mode. By arranging the operating lever 44 to be opposed to the middle portion of the contact lever 34 for operating the valve stem 19 of the start valve 15 and pivoting the operating lever 44 by the switch operating member 40, the amount of pivoting the contact lever 34 when the trigger lever is operated to be drawn to the middle portion is restricted and the valve stem 19 is maintained such that the ON operating state of the start valve 15 is maintained. Therefore, even when the start valve 15 is set such that the start valve 15 is operated to be ON by a fast timing of the operating stroke of the valve stem 19 to start the nailing machine 1 by the fast timing of the operating stroke of the contact arm 32 in the continuous striking mode to reduce the reaction in nailing, the start valve 15 is made to maintain the ON operating state by restricting the amount of pivoting the contact lever 34 by the operating lever 44 and therefore, the dribble striking in the single striking mode is prevented from being brought about.

Further, the operating lever 44 is engaged with the middle portion of the contact lever 34 and therefore, in a state of maximally operating to draw the trigger lever 31, the contact lever 34 and the operating lever 44 do not interfered with each other, when the position of operating the valve stem 19 by the contact lever 34 in the state of maximally operating to draw the trigger lever 31 is set to the lower side of the position of making the start valve 15 ON. Therefore, there can be prevented erroneous operation when in the state of maintaining the starting apparatus 30 in the single striking mode by operating the trigger lever 31 after operating the contact arm 32, the nailing machine 1 is connected to the air supply source thereafter.

Second Embodiment

Figure 11:
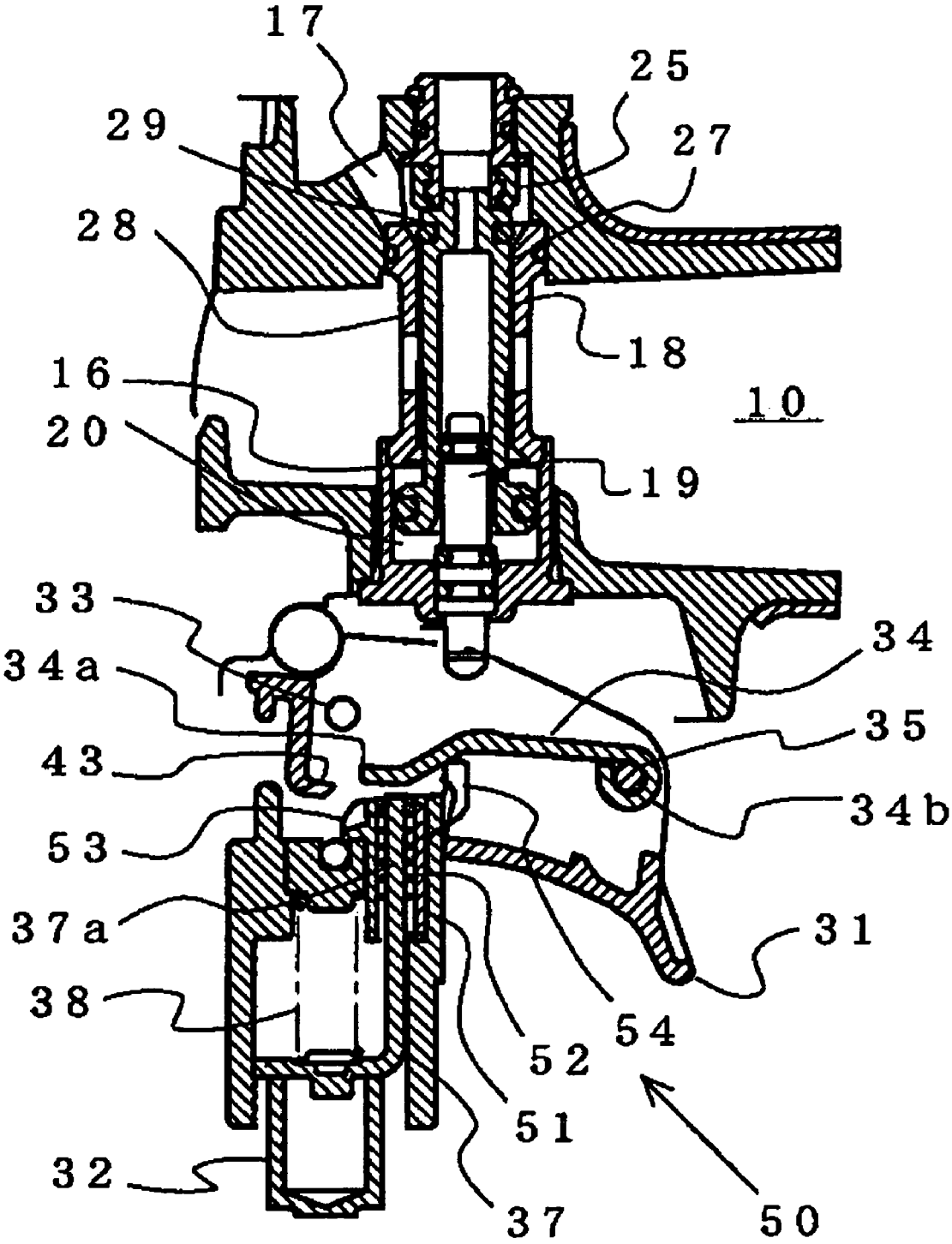
FIG. 11 is a sectional view showing a starting apparatus according to a second embodiment of the invention.

FIG. 11 through FIG. 14 show a second embodiment of a nailing machine of the invention. As shown by FIG. 11, according to a starting apparatus 50 of the embodiment, similar to the above-described first embodiment, a switch operating member 51 formed in a cylindrical shape to accommodate the vertical portion 37*a* of the L-like piece 37 connected to the upper end of the contact arm 32 is maintained by being urged to the upper side by a spring 52 arranged between the contact arm 32 and the switch operating member 51. An engaging projected portion 53 formed to be projected from the switch operating member 51 is engaged with the engaging jaw portion 43 formed at the trigger lever 31. Therefore, in the single striking mode of operating to draw the trigger lever 31 after operating the contact arm 32, the switch operating member 51 and the contact arm 32 are restricted from moving in the lower direction.

Further, according to the embodiment, an operating piece 54 projected to an upper side on a rear side of the switch operating member 51 is integrally formed with the switch operating member 51. When the switch operating member 51 is maintained at an upper position by being engaged with the trigger lever 31 to set to the single striking mode state, by engaging the middle portion of the contact lever 34 axially supported by the trigger lever 31 with the operating piece 54, the amount of pivoting the contact lever 34 in the state of operating to draw the trigger lever 31 to middle is restricted. As a result, the valve stem 19 of the start valve 15 is maintained upward from the position of making the start valve 15 OFF.

Further, in the state of operating to draw the trigger lever 31 to the maximum drawing position to set to the single striking mode after operating the contact arm 32, the axially supporting end 34*b* of the contact lever 34 is pivoted further to the upper side. However, in accordance with the pivoting, the contact lever 34 is pivoted centering on the middle portion engaged with the operating piece 54 and therefore, the position of operating to press the valve stem 19 of the contact lever 34 is not varied considerably. Therefore, erroneous operation is not brought about even when the valve stem 19 is maintained on the lower side of the position of making the start valve 15 ON and the nailing machine is connected to the compressed air supply source under the state.

The operation of the continuous striking mode of continuously striking a nail by swinging down the nailing machine in which the starting apparatus 50 according to the embodiment is embodied to the work is carried out quite similar to the above-described embodiment. First, the nailing machine 1 is swung down to be operated such that the nose portion 7 of the nailing machine 1 is pressed to the work while maintaining the state of operating to draw the trigger lever 31. When the contact arm 32 is operated upward by the operation and the valve stem 19 of the start valve 15 is operated to the position of operating to make the start valve 15 ON, the nailing machine 1 is started. When the nose portion 7 of the nailing machine 1 is separated from the work to operate to release the contact arm 32 in the state of operating to start the trigger lever 31, the L-like piece 37 at the upper end of the contact arm 32 is moved downward. In accordance therewith, the contact lever 34 is pivoted, the valve stem 19 is operated to the position of operating to make the start valve OFF, and the start valve 15 returns to the OFF state. Thereafter, when the nose portion 7 of the nailing machine is pressed to the work again to operate the contact arm 32, the contact lever 34 is pivoted again, the valve stem 19 is pressed again, the start valve 15 is operated to be ON and the nailing machine 1 is started. That is, the nailing machine 1 can continuously be started by only repeating the operation of the contact arm 32 so far as the trigger lever 31 is operated to draw.

Figure 12:
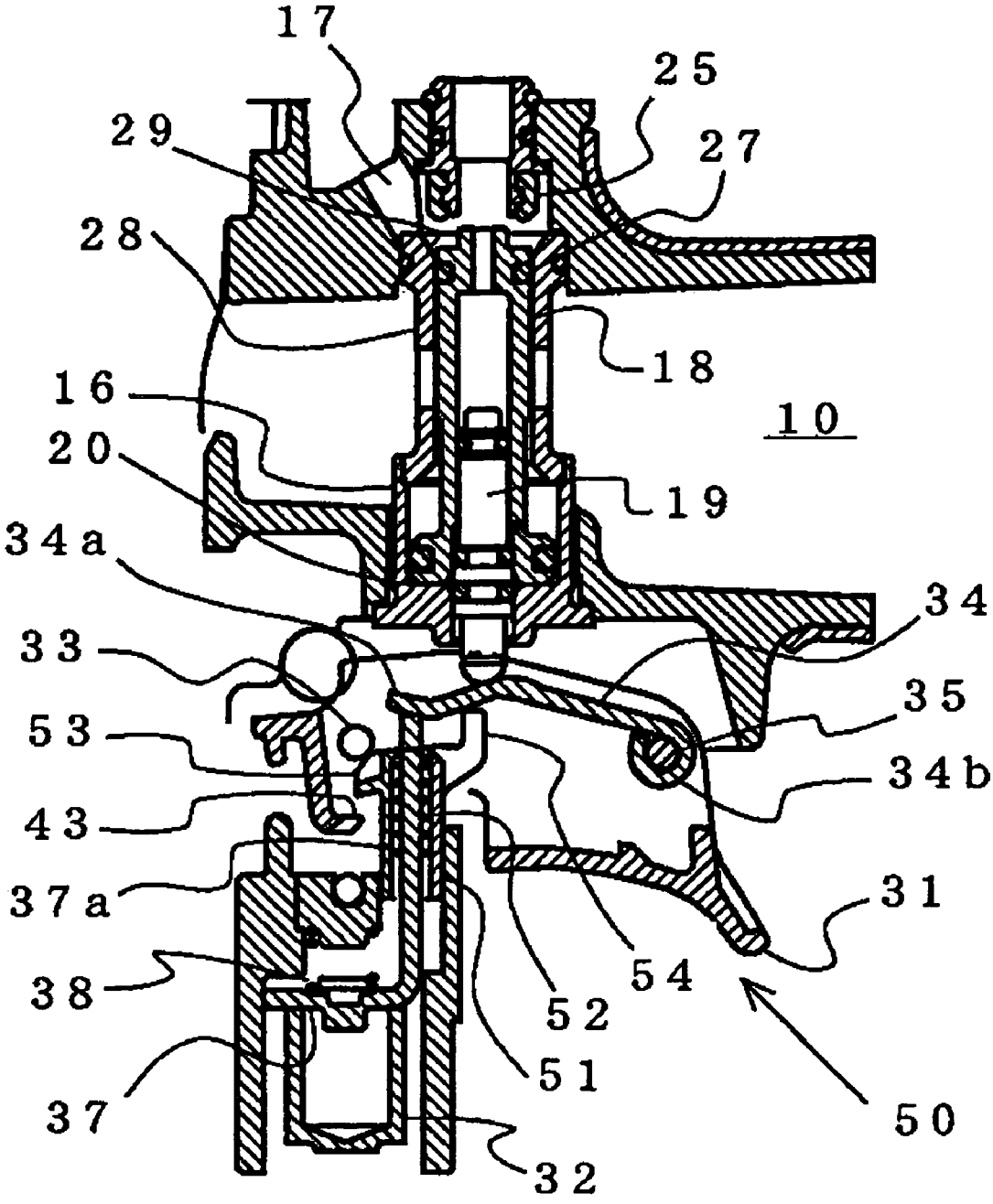
FIG. 12 is a sectional view of the starting apparatus the same that of FIG. 11 showing a state of operating a contact arm to an upper dead center by a single striking mode.

Next, when the single striking mode is selected, first, the nose portion 7 of the nailing machine 1 is operated to be pressed to the nailing portion of the work. Thereby, the contact arm 32 is operated and the upper end portion of the contact arm 32 is moved upward. The operating end 34*a* of the contact lever 34 is pressed up in the upper direction by the L-like piece 37 and the contact lever 34 is pivoted. Under the state, the trigger lever 31 is not operated to pivot and therefore, the valve stem 19 of the start valve 15 is not operated by pivoting the contact lever 34. Further, at this occasion, the switch operating member 51 is moved upward in accordance with the upward movement of the contact arm 32. When the trigger lever 31 is operated to draw from the state, as shown by FIG. 12, by pivoting the trigger lever 31, the side of the axially supporting end 34*b* of the contact lever 34 is moved to the upper side. Further, the contact lever 34 is pivoted centering on the side of the operating end 34*a* supported by the L-like piece 37. Thereby, when the valve stem 19 of the start valve 15 is pressed up and the position of the valve stem 19 is operated to the position of operating to make the start valve 15 ON, the start valve 15 is operated to be ON and the nailing machine 1 is started.

Figure 13:
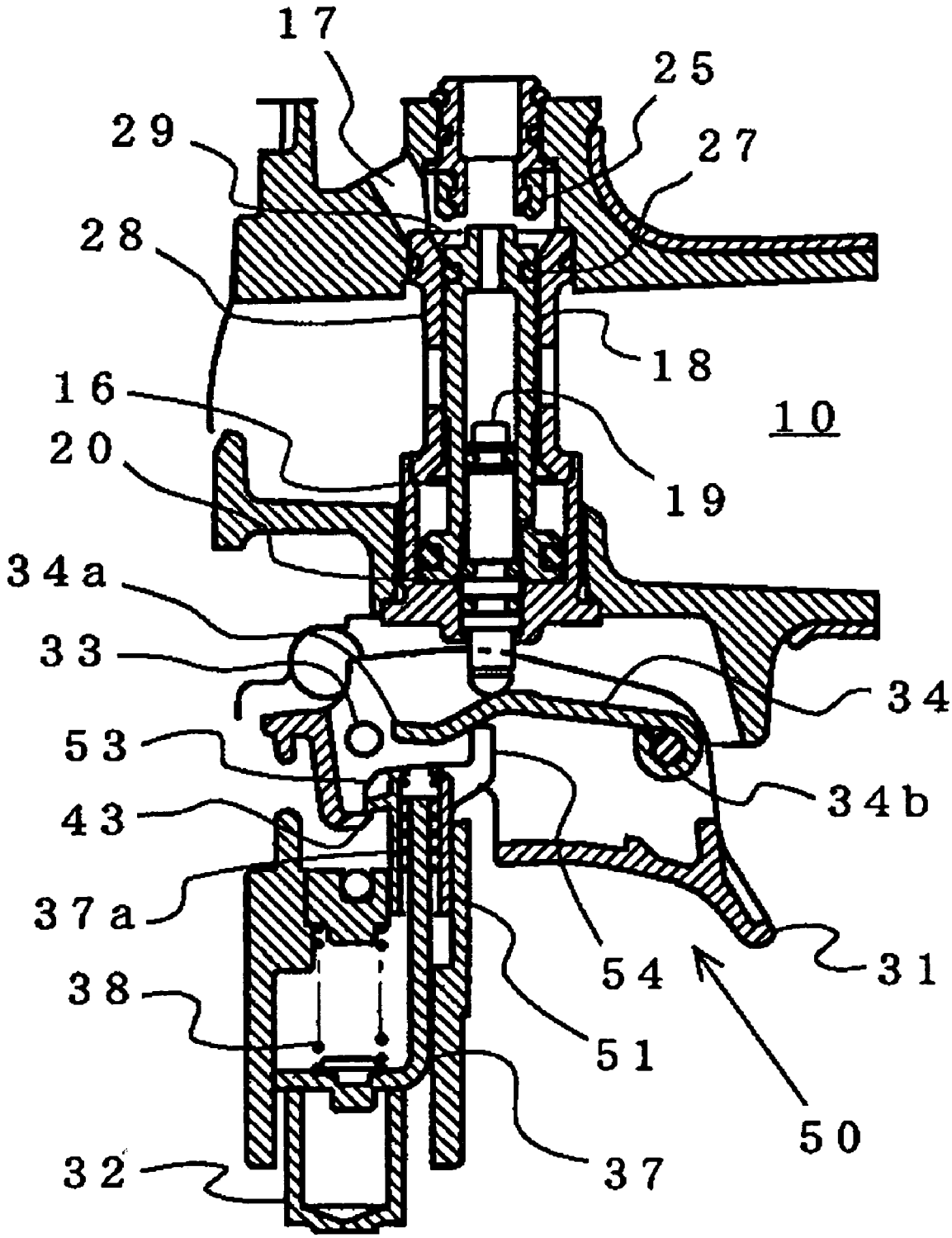
FIG. 13 is a sectional view of the starting apparatus the same as that of FIG. 11 showing an operating state at an instance of staring the nailing machine by operating a trigger lever.

When the contact arm 32 is returned to the lower direction by separating the nailing machine 1 from the face of the work by the reaction at an instance of driving the nailing machine 1, by moving down the L-like piece 37, the side of the operating end 34*a* of the contact lever 34 is pivoted in the lower direction, thereby, the valve stem 19 is returned in the direction of the lower dead center. However, as shown by FIG. 13, the switch operating member 51 is engaged with the trigger lever 31 to be maintained at the upper position, the contact lever 34 is engaged with the operating piece 54 integrally formed with the switch operating member 51 to restrict the pivoting amount. Therefore, the valve stem 19 is not moved down to the position of operating to make the start valve 15 of the valve stem 19 OFF. Therefore, the start valve 15 maintains the ON state and therefore, even when the nailing machine 1 moved upward by the reaction is moved down and the contact arm 32 is operated again, the nail is not struck. That is, the dribble striking is not brought about.

Figure 14:
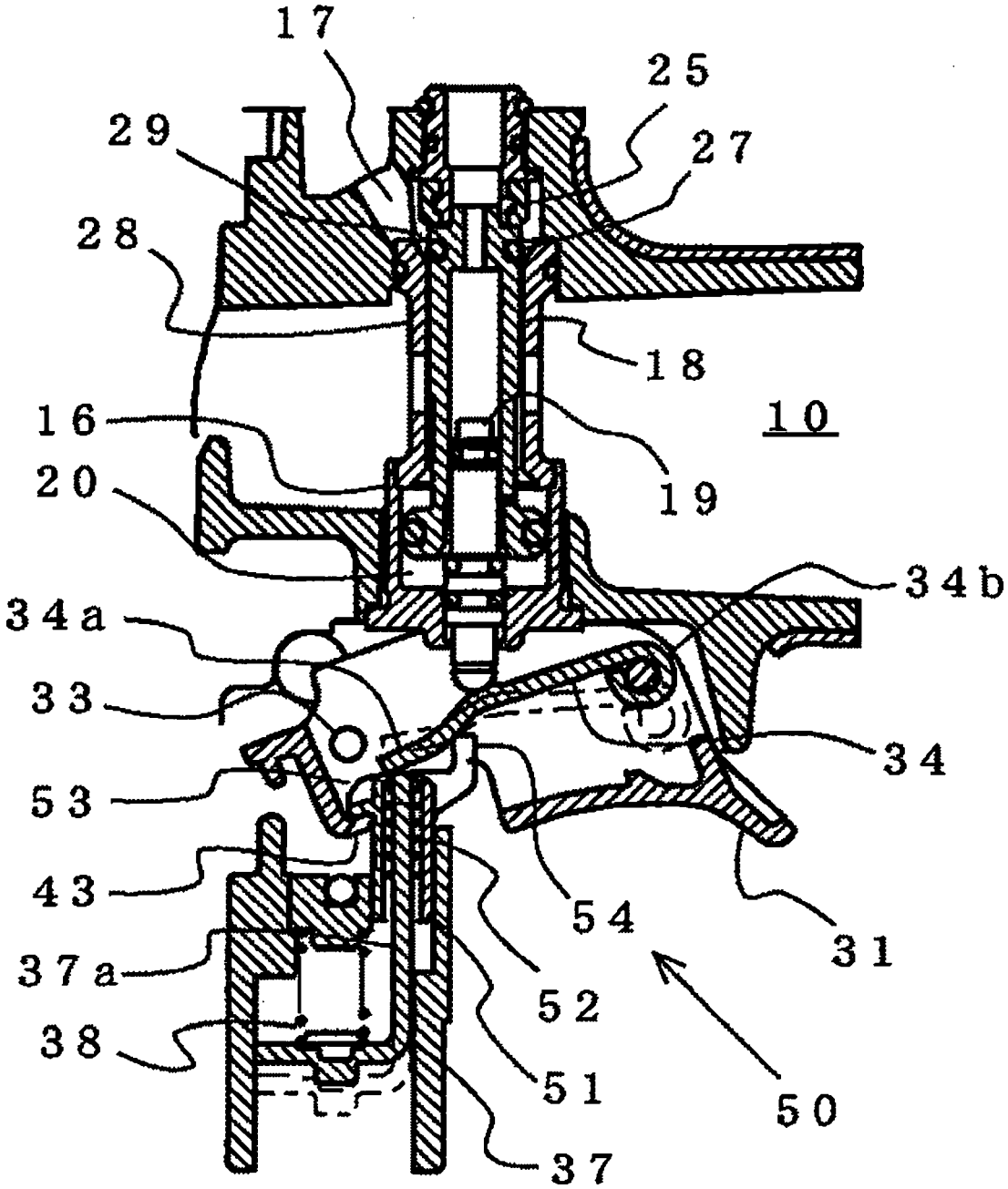
FIG. 14 is a sectional view of the starting apparatus the same as that of FIG. 11 showing a state of maintaining the single striking mode by operating to draw the trigger lever to a maximum drawing position.

Further, when the contact arm 32 is operated in the state in which the nailing machine 1 is not connected to the air supply source, thereafter, the single striking mode is maintained by operating the trigger lever 31, thereafter, and the nailing machine 1 is connected to the compressed air supply source, as shown by FIG. 14, the trigger lever 31 is brought into a state of being operated to draw maximally, under the state, the contact lever 34 is not engaged with the operating piece 54 integrally formed with the switch operating member 51 and the operating end 34*a* at the front end is engaged with the upper end face of the switch operating member 51. Therefore, the valve stem 19 of the start valve 15 is not moved upward from the position of making the start valve 15 ON. Therefore, even when compressed air is supplied to the nailing machine 1 after operating to set the single striking mode, the nailing machine 1 is not erroneously operated.

INDUSTRIAL APPLICABILITY

According to the invention, in the nailing machine for automatically select to switch the respective modes of continuous striking and single striking by selecting an order of operating two members of the trigger lever and the contact arm, the switch operating member for setting to switch the single striking mode and the continuous striking mode is provided, the pivot restricting mechanism for restricting pivoting of the contact lever in cooperation with the switch operating member set to the single striking mode is provided, and an amount of pivoting the contact lever at the position of operating to draw the middle of the trigger lever in the single striking mode is restricted by the pivot restricting mechanism. Thereby, the valve stem is maintained to maintain the state of operating to make the start valve ON in the single striking mode.

Therefore, the reaction of the nailing machine in continuously nailing in the continuous striking mode can be reduced, further, the dribble in the single striking mode is prevented from being brought about and the erroneous operation in connecting the air chuck in the state of maintaining the single striking mode is prevented.

The invention claimed is:

1. A nailing machine comprising:

a striking mechanism including a piston integrally coupled with a driver for striking a nail and a cylinder slidably accommodating the piston;

a housing accommodating the striking mechanism and attached with a nose portion for slidably guiding the driver at a front end thereof;

a start valve for driving the striking mechanism by supplying compressed air into the cylinder and returning the striking mechanism to an initial position by exhausting the compressed air in the cylinder;

a trigger lever operated by the of a user finger;

a contact arm operated by bringing the nose portion into contact with a work;

a contact lever, wherein one end side of the contact lever is axially supported pivotably, an operating end on another end of the contact lever is arranged to be opposed to an upper end of the contact arm, and the contact lever is operated to pivot by operating the trigger lever and the contact arm;

a valve stem provided at the start valve and operated by the contact lever;

a switch operating member provided at a front end portion of the contact arm for setting to switch a single striking mode and a continuous striking mode; and a pivot restricting mechanism for restricting the contact lever from being pivoted to maintain the valve stem to maintain a state of operating to make the start valve ON when the switch operating member is set to be switched to the single striking mode.

2. The nailing machine according to claim 1, wherein the pivot restricting mechanism includes an operating lever supported so as to be pivoted by the switch operating member, the operating lever is arranged to be opposed to the contact lever, and the operating lever restricts an amount of pivoting the contact lever by being engaged with a middle portion of the contact lever when the switch operating member is set to the single striking mode.

3. The nailing machine according to claim 1, wherein the pivot restricting mechanism includes an operating piece formed to direct upward at the switch operating member, the operating piece is arranged to be opposed to a middle portion of the contact lever, and the operating piece restricts an amount of pivoting the contact lever by being engaged with the middle portion of the contact lever when the switch operating member is set to the single striking mode.

4. The nailing machine according to claim 1, wherein the switch operating member moves upward so as to set the single striking mode when the contact arm is operated in a state in which the trigger lever is not operated, and the switch operating member is hampered from moving upward so as to set the continuous striking mode when the trigger lever is operated in a state in which the contact arm is not operated.

5. The nailing machine according to claim 1, wherein the valve stem is operated among a lower dead center, an upper dead center, a first middle portion at which the start valve in a state of being operated to be OFF is operated to be ON when the valve stem is operated in a direction to the upper dead center from the lower dead center, and a second middle position at which the start valve in a state of being operated to be ON is operated to be OFF when the valve stem is operated in a direction to the lower dead center from the upper dead center, and wherein the first middle position is positioned to a side of the upper dead center than the second middle position.

6. The nailing machine according to claim 5, wherein the valve stem is maintained on a side of the upper dead center than the second middle position when the contact lever is restricted from being pivoted by the pivot restricting mechanism.

* * * * *